US012510068B2

(12) United States Patent
Dominguez-Anaya

(10) Patent No.: US 12,510,068 B2
(45) Date of Patent: Dec. 30, 2025

(54) AUTOMATED VALVE ACTUATION FOR FRAC FLUID ENDS USING POSITION AND/OR PRESSURE SENSORS

(71) Applicant: FORUM US, INC., Houston, TX (US)

(72) Inventor: Saul Dominguez-Anaya, Mansfield, TX (US)

(73) Assignee: FORUM US, INC., Houston, TX (US)

( * ) Notice: Subject to any disclaimer, the term of this patent is extended or adjusted under 35 U.S.C. 154(b) by 13 days.

(21) Appl. No.: 18/596,922

(22) Filed: Mar. 6, 2024

(65) Prior Publication Data

US 2025/0283460 A1 Sep. 11, 2025

(51) Int. Cl.
*F04B 49/22* (2006.01)
*F04B 53/16* (2006.01)

(52) U.S. Cl.
CPC ..... *F04B 49/22* (2013.01); *F04B 53/16* (2013.01); *F04B 2201/06* (2013.01); *F04B 2205/02* (2013.01); *F04B 2205/03* (2013.01); *F04B 2205/04* (2013.01)

(58) Field of Classification Search
CPC ..... F04B 49/22; F04B 53/16; F04B 2201/06; F04B 2205/02; F04B 2205/03; F04B 2205/04; E21B 43/2607
See application file for complete search history.

(56) References Cited

U.S. PATENT DOCUMENTS 5,846,056 A * 12/1998 Dhindsa ..... F04B 49/065 73/152.52
8,366,402 B2 * 2/2013 St. Michel ..... F04B 19/22 417/63
8,366,408 B2 * 2/2013 Wago ..... F04B 53/1032 417/295
10,247,184 B2 * 4/2019 Chunn ..... F04B 53/143
10,876,523 B2 12/2020 Bridges
10,941,765 B2 3/2021 Nowell et al.
11,346,336 B2 * 5/2022 Surjaatmadja ..... F04B 49/065
11,506,189 B2 11/2022 Bridges
(Continued)

FOREIGN PATENT DOCUMENTS

EP 2699800 B1 7/2018
JP 2021094545 A * 6/2021
(Continued)

OTHER PUBLICATIONS

PCT International Search Report and Written Opinion dated Jun. 5, 2025, for International Application No. PCT/US2025/018469.

*Primary Examiner* — Nathan C Zollinger
(74) *Attorney, Agent, or Firm* — Patterson + Sheridan, LLP

(57) ABSTRACT

A pump includes a power end and a fluid end coupled to the power end. The power end includes a plunger, and the fluid end includes a crossbore in selective fluid communication with inlet and outlet bores. A suction valve controls fluid communication between the inlet bore and the crossbore, and a discharge valve controls fluid communication between the outlet bore and the crossbore. An actuation device is used to move the discharge valve between an open position and a closed position. A position sensor measures a position of the plunger. A pressure sensor measures a pressure of the crossbore, the inlet bore, or the outlet bore. A controller operates the discharge valve based on data from at least one of the position sensor or the pressure sensor.

16 Claims, 6 Drawing Sheets

(56) References Cited

U.S. PATENT DOCUMENTS

| | | | | |
|---|---|---|---|---|
| 12,366,241 | B2 * | 7/2025 | He | F04B 47/00 |
| 2007/0140869 | A1 | 6/2007 | St. Michel et al. | |
| 2008/0279705 | A1 * | 11/2008 | Wago | F04B 49/243 251/65 |
| 2009/0041588 | A1 * | 2/2009 | Hunter | F04B 7/0076 417/27 |
| 2010/0143171 | A1 * | 6/2010 | Gaumnitz | F04B 53/1082 417/505 |
| 2010/0183448 | A1 * | 7/2010 | Leugemors | F04B 49/22 417/53 |
| 2016/0208794 | A1 | 7/2016 | Singh et al. | |
| 2018/0100496 | A1 | 4/2018 | Zhang et al. | |
| 2022/0356791 | A1 * | 11/2022 | Coli | B01F 27/05 |
| 2023/0145747 | A1 * | 5/2023 | Harris | F04B 53/10 417/510 |

FOREIGN PATENT DOCUMENTS

| | | | | |
|---|---|---|---|---|
| WO | WO-2021178335 | A1 * | 9/2021 | E21B 43/2607 |
| WO | WO-2023097330 | A1 * | 6/2023 | F04B 53/1022 |

* cited by examiner

AUTOMATED VALVE ACTUATION FOR FRAC FLUID ENDS USING POSITION AND/OR PRESSURE SENSORS

BACKGROUND

Field

Embodiments of the disclosure relate to a pump, more specifically, to a valve actuation system for fracturing pumps and other pump designs.

Description of the Related Art

In drilling and completion of a well, fluids are pumped into a wellbore to conduct various downhole operations. For example, fracturing fluids can be pumped downhole to fracture the formation to increase permeability of the formation. In another example, cement can be pumped into an annulus between a wellbore casing and a subterranean surface. After the cement is set, the cement can support and protect the wellbore casing from exterior corrosion and pressure changes.

Pumps for pumping these fluids typically have a power end and a fluid end. The fluid end may use valves for controlling the flow of fluid in and out of the fluid end. In one example, the valve is operated by a spring. The spring opens when a pressure differential across the valve is sufficient to overcome the biasing force of the spring. However, problems may arise when the valve does not fully open due to a low pressure differential. A partially opened valve will cause the velocity of the fluid to increase, thereby causing more wear on the valve or the valve seat. A low pressure differential may also cause the valve to open and close more frequently, which also leads to wear on the valve or the valve seat.

There is, therefore, is a need for improved valve designs and valve actuation systems for pumps.

SUMMARY

In one embodiment, a pump includes a power end and a fluid end coupled to the power end. The power end includes a plunger movable between a retracted position and an extended position. The fluid end includes an inlet bore; an outlet bore; and a crossbore in selective fluid communication with the inlet bore and the outlet bore. A suction valve is provided to control fluid communication between the inlet bore and the crossbore, and a discharge valve is provided to control fluid communication between the outlet bore and the crossbore. An actuation device is used to move the discharge valve between an open position and a closed position. The pump also includes at least one of a position sensor for measuring a position of the plunger or a pressure sensor for measuring a pressure of the crossbore, the inlet bore, or the outlet bore. The pump includes a controller for operating the discharge valve based on data from at least one of the position sensor or the pressure sensor.

In one embodiment, a method of operating a pump is provided herein. The method includes extending a plunger into a crossbore of the pump and determining a position of the plunger. In response to the plunger crossing a discharge position threshold, a discharge valve in the pump is opened to discharge fluid from the crossbore into an outlet bore of the pump. The method also includes retracting the plunger and determining the position of the plunger. In response to the plunger crossing a suction position threshold, the discharge valve is closed. An inlet bore is opened to allow fluid to flow into the crossbore.

In one embodiment, a method of operating a pump includes extending a plunger into a crossbore of the pump. The crossbore is in selective fluid communication with an outlet bore and an inlet bore. The method also includes determining a pressure in at least one of the crossbore, the outlet bore, and the inlet bore. In response to the pressure reaching a discharge pressure threshold, a discharge valve in the pump is opened to discharge fluid from the crossbore into the outlet bore. The method also includes retracting the plunger. In response to the pressure reaching a suction pressure threshold, the discharge valve is closed. The inlet bore is opened to allow fluid to flow into the crossbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

For clarity, identical reference numerals have been used, where applicable, to designate identical elements that are common between figures. Additionally, elements of one embodiment may be advantageously adapted for utilization in other embodiments described herein.

DETAILED DESCRIPTION

In one embodiment, a pump includes a power end and a fluid end coupled to the power end. The power end includes a plunger movable between a retracted position and an extended position. The fluid end includes an inlet bore; an outlet bore; and a crossbore in selective fluid communication with the inlet bore and the outlet bore. A suction valve is provided to control fluid communication between the inlet bore and the crossbore, and a discharge valve is provided to control fluid communication between the outlet bore and the crossbore. An actuation device is used to move the discharge valve between an open position and a closed position. The actuation device can advantageously maintain the discharge valve in the open position during discharge and the closed position during suction. The actuation device beneficially limits the impact between the valve body and the valve seat, thereby reducing wear on the discharge valve. The pump also includes at least one of a position sensor for measuring a position of the plunger or a pressure sensor for measuring a pressure of the crossbore, the inlet bore, or the outlet bore.

The pump includes a controller for operating the discharge valve based on data from at least one of the position sensor or the pressure sensor.

Figure 1:
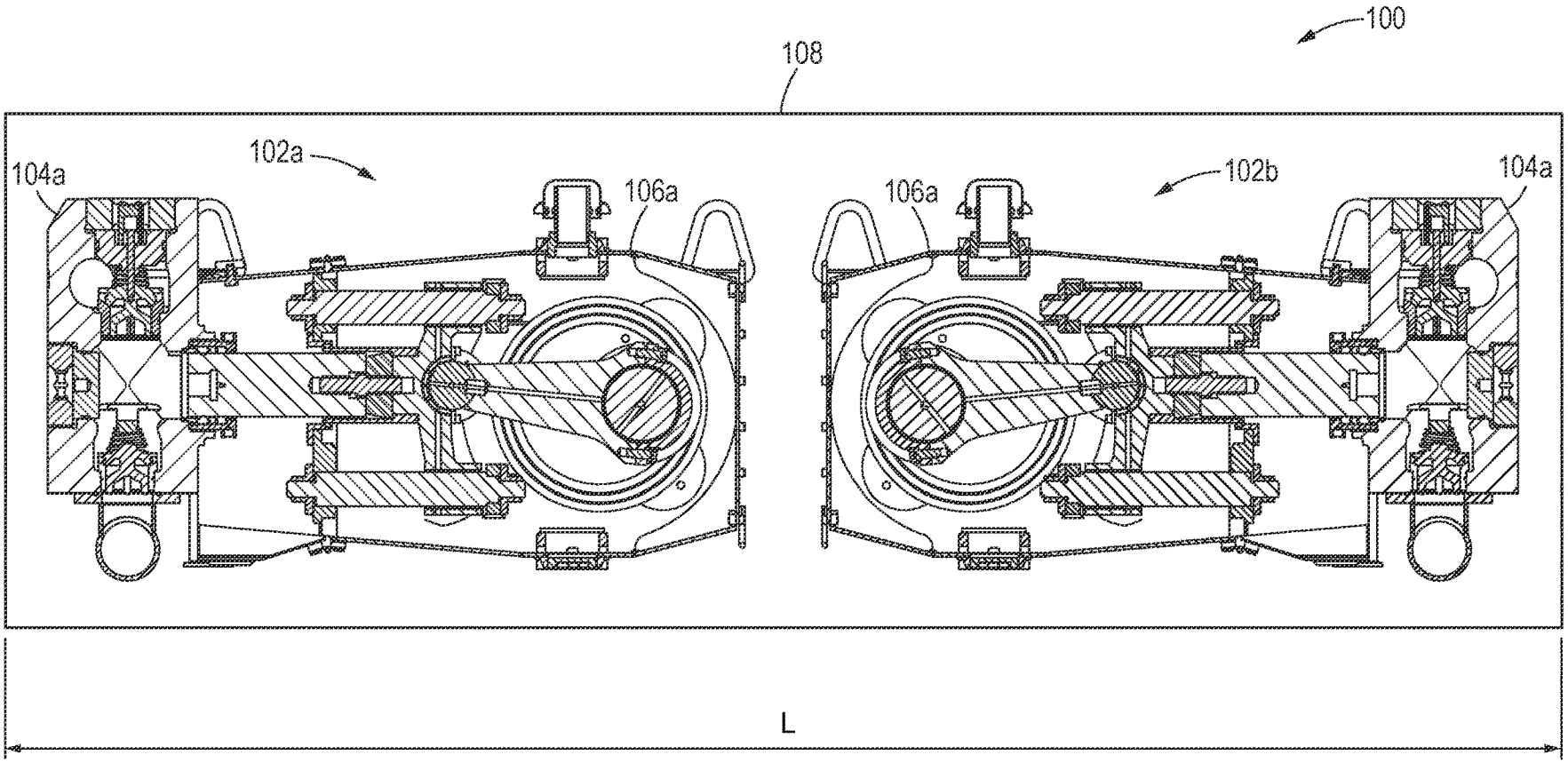
FIG. 1 illustrates a pump system, according to one embodiment.

FIG. 1 illustrates a pump system 100, according to one embodiment. The pump system 100 includes a first pump 102*a* and a second pump 102*b*. The first pump 102*a* includes a fluid end 104*a* and a power end 106*a*. The second pump 102*b* includes a fluid end 104*b* and a power end 106*b*. The pumps 102*a*, 102*b* are mounted in a back-to-back configuration on a platform 108. For example, the platform 108 may be a skid, truck bed, trailer, etc. In the embodiment illustrated in FIG. 1, the pumps 102*a*, 102*b* are identical. In another embodiment, the pumps 102*a*, 102*b* may be different. The disclosure of the pump system 100 is exemplarily described as pumping fracturing fluids. However, embodiments of the pumps 102*a*, 102*b* may be applied to pumping cement, mud, and other wellbore fluids.

According to one embodiment, the pumps 102*a*, 102*b* are compact in size so as to permit the two pumps 102*a*, 102*b* to be oriented in the back-to-back configuration. For example, government regulations often provide vehicle width restrictions for operation on public roadways. In some embodiments, the pump system 100 has a total length L that is less than or equal to a roadway width restriction. For example, the pump system 100 has a total length L equal to or less than 102 inches (i.e., roadway length restriction).

Figure 2A:
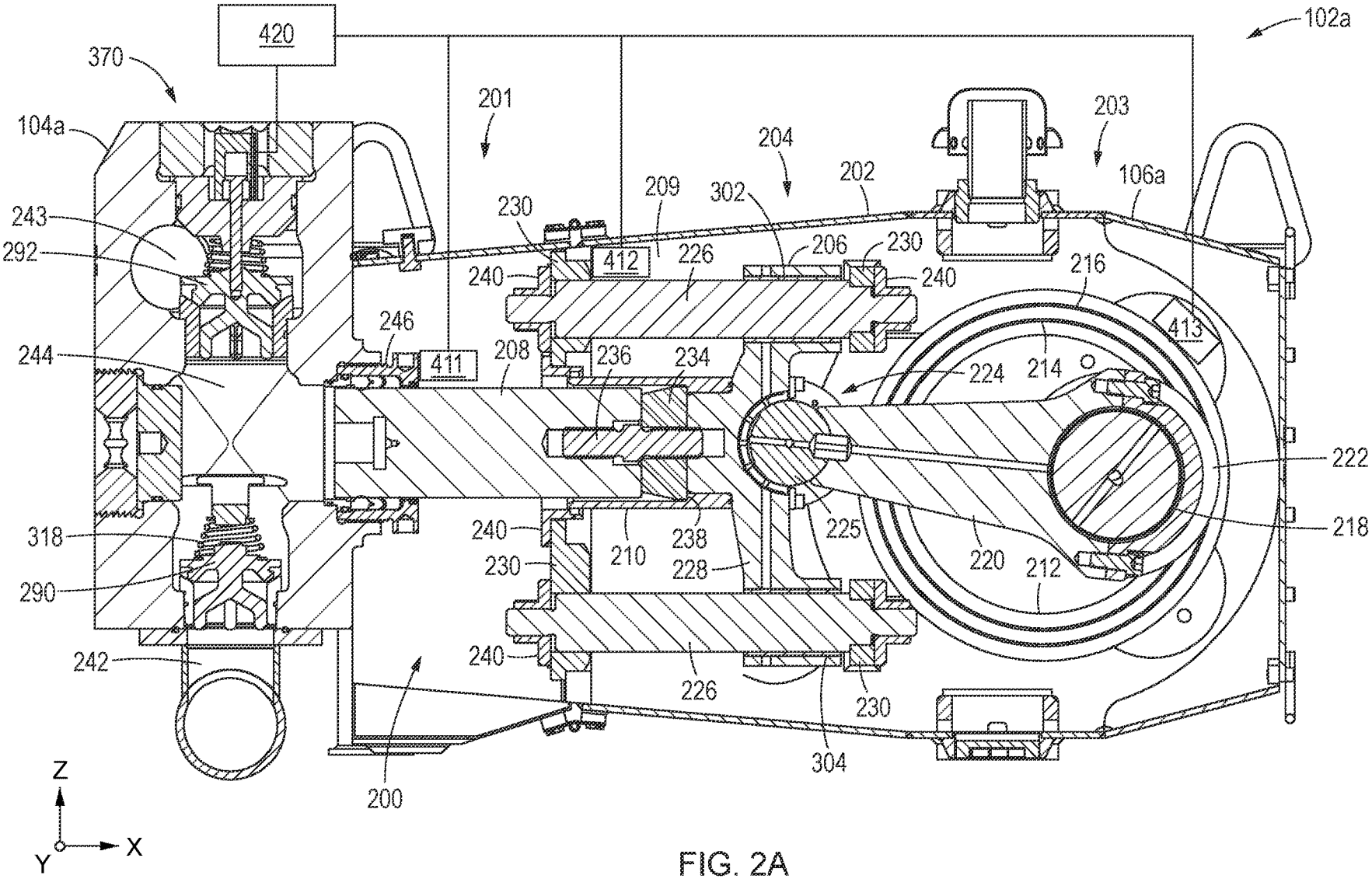
FIG. 2A-2B illustrate sectional views of a pump from the pump system in FIG. 1 at different positions during operation, according to one embodiment.
Figure 2B:
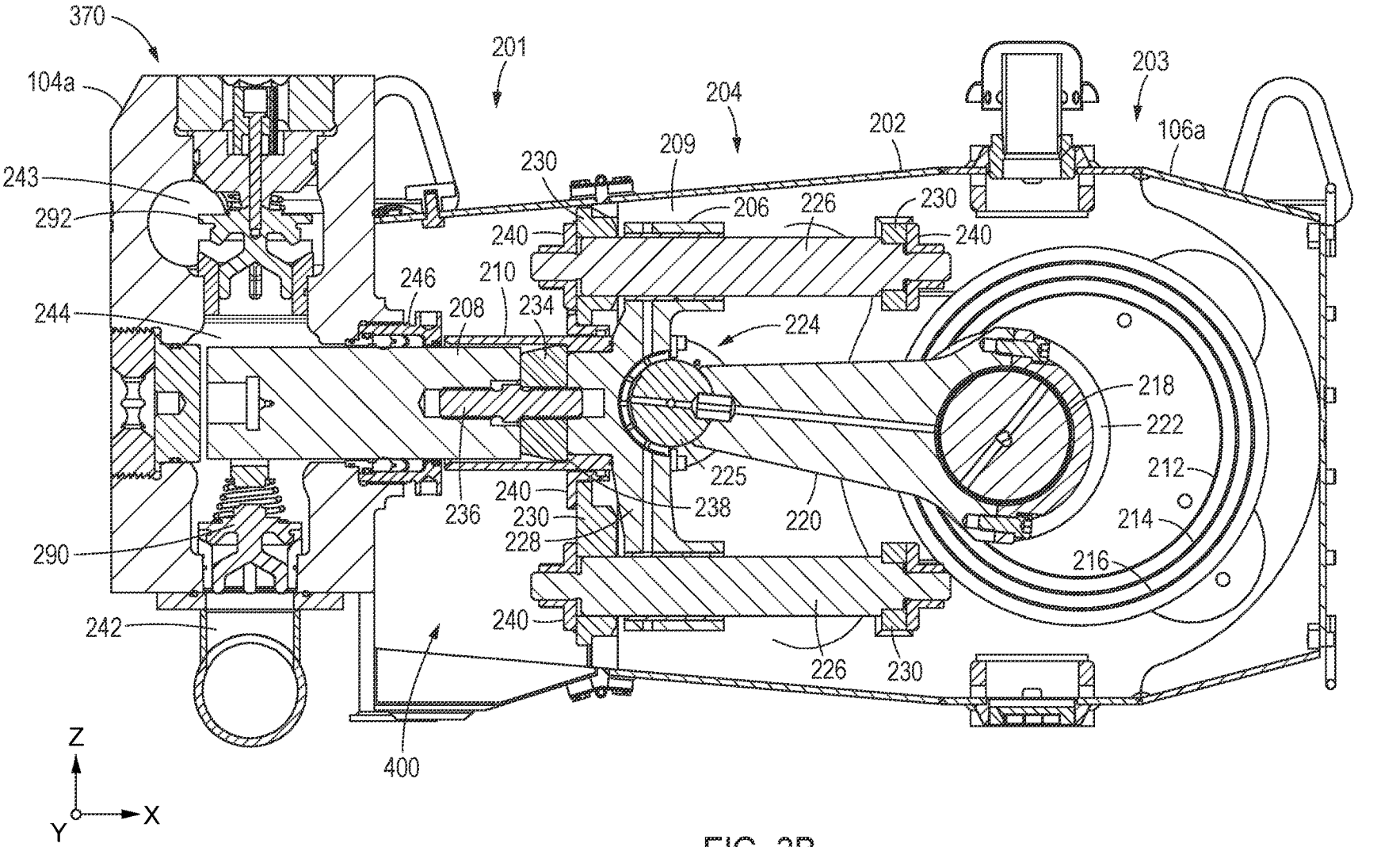

FIGS. 2A and 2B illustrate sectional views of the pump 102*a* from the pump system 100 of FIG. 1 at different positions during operation, according to one embodiment. The pump 102*b* may operate in the same manner. The power end 106*a* is shown in a fully retracted position 200 in FIG. 2A. The power end 106*a* includes a pump housing 202 and a plunger assembly 204.

The pump housing 202 defines an interior volume 209, which includes a fluid end section 201 and a power end section 203. The fluid end section 201 is coupled to the fluid end 104*a*. The plunger assembly 204 is disposed within the pump housing 202 and reciprocates between the fluid end section 201 and the power end section 203. The plunger assembly 204 is operable to cycle between a fully extended position 400 shown in FIG. 2B and the fully retracted position 200 shown in FIG. 2A when pumping fluid. For example, the plunger assembly 204 may pump fluid, such as fracturing fluids, through the fluid end 104*a* under high pressure into an oil or gas well.

The power end 106*a* further includes a crankshaft 212 rotatably mounted in the power end section 203 of the pump housing 202. The crankshaft 212 includes a crankshaft axis 214 about which the crankshaft 212 rotates. The crankshaft 212 is mounted in the power end section 203 with bearings 216. The crankshaft 212 further includes a journal 218, which is a shaft portion to which a connecting rod 220 is attached. The connecting rod 220 includes a crankshaft end 222 and a crosshead end 224. The crankshaft end 222 is coupled to the crankshaft 212, and the crosshead end 224 is coupled to a crosshead 206. The crosshead end 224 may be coupled to the crosshead 206 by a wristpin 225. In one embodiment, the wristpin 225 is disposed in a cavity 314 of the crosshead 206.

The plunger assembly 204 may include the crosshead 206, a plunger 208, and a sleeve 210 that forms a fluid seal between the plunger 208 and the crosshead 206 as further described below. The crosshead 206 reciprocates within the pump housing 202 along a plurality of rods 226, such as two, three, four, or more, disposed in the pump housing 202. The rods 226 are secured in the pump housing 202 by a retainer member 230. The crosshead 206 includes an elongated body 228 that may be "T" shaped. The crosshead 206 includes openings 302, 304 for coupling with the rods 226. In some embodiments, a bushing is disposed in the openings 302, 304, and the bushing encircles and moves along the rods 226. The elongated body 228 of the crosshead 206 allows for more space within the pump housing 202. The additional space created in the pump housing 202 by the elongated body 228 of the crosshead 206 allows the sleeve 210 to fit within the pump housing 202. The elongated body 228 also allows for a longer plunger 208 to be implemented in the pump 102*a*.

The sleeve 210 is coupled to the crosshead 206 and is at least partially disposed within a space defined between the rods 226. In one embodiment, the sleeve 210 and the crosshead 206 may be formed as an integral, single piece. In the embodiment shown in FIGS. 2A and 2B, the sleeve 210 and the crosshead 206 are shown as separate pieces. The sleeve 210 at least partially surrounds the plunger 208 and an end of the crosshead 206, forming a fluid seal between the plunger 208 and the crosshead 206. The plunger 208 is optionally coupled to the crosshead 206 via a retainer plate 234 and screw 236. The retainer plate 234 sits in a step 238 formed in the sleeve 210. The screw 236 is disposed through the retainer plate 234 and is threaded into the crosshead 206 at one end and the plunger 208 at an opposite end. In an alternative embodiment, the retainer plate 234 may be coupled directly to the crosshead 206 (such as by cap screws), and the screw 236 may be threaded into the retainer plate 234 at one end and the plunger 208 at an opposite end (as further described below and shown with respect to FIG. 3B).

A plurality of sealing members 240 is coupled to the sleeve 210 and the rods 226. The sleeve 210, the plurality of sealing members 240, and the retainer member 230 form a barrier, such as a fluid seal, between the fluid end section 201 and the power end section 203 of the pump housing 202 to prevent fluid contamination between the fluid end section 201 and the power end section 203. The sleeve 210 moves with the plunger 208 as the crankshaft 212 rotates, thus maintaining the barrier between the power end section 203 and the fluid end section 201 at all points during operation of the crankshaft 212.

The fluid end 104*a* is coupled to the fluid end section 201 of the pump housing 202. The fluid end 104*a* includes a suction valve 290 and a discharge valve 292. The suction valve 290 is disposed in an inlet bore 242, and the discharge valve 292 is disposed in an outlet bore 243. A crossbore 244 is disposed between the inlet bore 242 and the outlet bore 243, and the crossbore 244 is in selective fluid communication with the inlet bore 242 and the outlet bore 243. A fluid end seal assembly 246 is disposed adjacent to one end of the crossbore 244 that leads into the fluid end section 201 of the pump housing 202. In one embodiment, the fluid end seal assembly 246 may include one or more seals, such as an O-ring, positioned within the crossbore 244 to form a fluid seal between the crossbore 244, the plunger 208, and the fluid end section 201 of the pump housing 202. The fluid end seal assembly 246 prevents fluid in the crossbore 244 from flowing into the fluid end section 201 of the pump housing 202.

The discharge valve 292 is disposed in the outlet bore 243 to control fluid communication between the outlet bore 243 and the crossbore 244. The suction valve 290 is disposed in the inlet bore 242 to control fluid communication between the inlet bore 242 and the crossbore 244. The suction valve 290 includes the same features as the discharge valve 292, and the discussion herein with respect to the discharge valve 292 is equally applicable to the suction valve 290.

Figure 3:
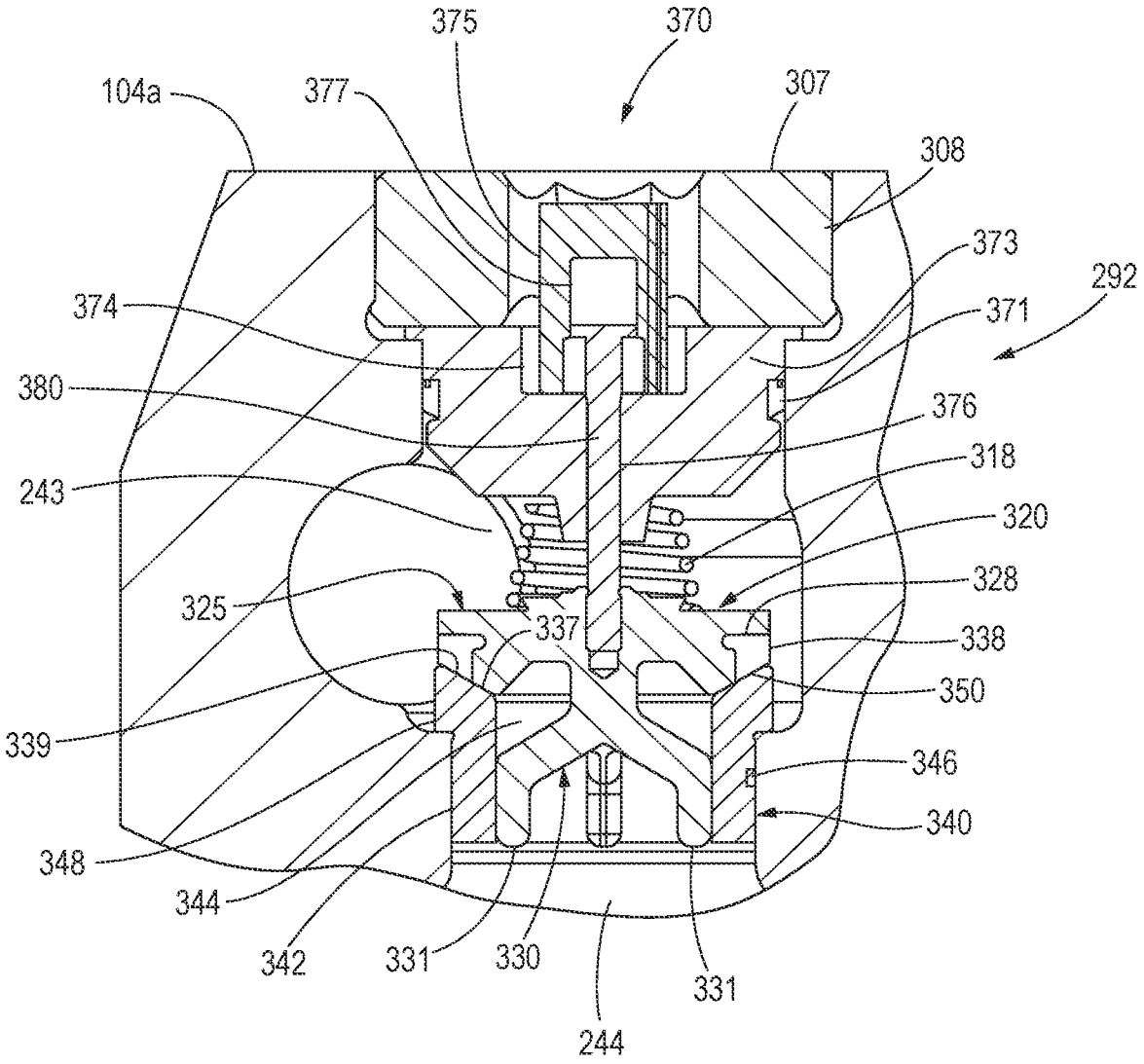
FIG. 3 illustrates an exemplary embodiment of a discharge valve for a pump, according to one embodiment.

FIG. 3 is an exemplary embodiment of the discharge valve 292. In one embodiment, the discharge valve 292 includes a valve body 320 configured for sealing engagement with a valve seat 340. The valve seat 340 includes a cylindrical body 342 having a bore 344 extending therethrough. The cylindrical body 342 is disposed in the outlet bore 243 and includes an outer shoulder 348 disposed against a ledge formed in the outlet bore 243. A sealing member 346, such as an o-ring, is disposed between the cylindrical body 342 and the outlet bore 243 to prevent fluid communication therebetween. The cylindrical body 342 includes a sealing surface 350 for sealing engagement with the valve body 320. In one embodiment, the sealing surface 350 tapers radially inward and downwardly for engaging the valve body 320.

The valve body 320 includes a seal portion 325 connected to a guide portion 330. The guide portion 330 is configured for engagement with the inner surface of the valve seat 340. In one example, the guide portion 330 includes a plurality of guide arms 331 in contact with the inner surface of the valve seat 340. The plurality of guide arms 331 facilitate alignment of the valve body 320 with respect to the valve seat 340 as the valve body 320 moves toward and away from the valve seat 340. The plurality of guide arms 331 may be circumferentially spaced and include any suitable number of arms 331, such as three, four, five or more arms 331. The seal portion 325 has an outer diameter that is larger than the diameter of the bore 344 of the valve seat 340. A recess 328 is formed in the outer surface of the seal portion 325 for receiving a valve seal 338. The valve seal 338 includes a sealing surface 339 for sealing engagement with the sealing surface 350 of the valve seat 340. In this embodiment, the seal portion 325 includes an optional lower sealing surface 337 adjacent the valve seal 338 for sealing engagement with the sealing surface of the valve seat 340. In some embodiments, the valve seal 338 is optional, and the lower sealing surface 337 may be extended to engage the sealing surface 350 of the valve seat 340. In some embodiments, the valve seal 338 is integral with the seal portion 325. In some embodiments, the valve seal 338 may be sufficiently sized to sealingly engage with the valve seat 340 such that the lower sealing surface 337 is optional.

In one embodiment, the discharge valve 292 includes a piston and cylinder assembly 370 for moving the valve body 320 between an open position and a closed position. FIG. 3 shows the valve body 320 in the closed position in which the valve seal 338 and the lower sealing surface 337 are engaged with the valve seat 340. The cylinder 375 of the piston and cylinder assembly 370 is at least partially disposed in a retaining member 307, such as a retaining nut, and coupled to a piston support 373. The retaining member 307 is disposed in an access opening 308 of the fluid end 104*a*, and the piston support 373 is disposed inward of the retaining member 307 in the access opening 308. A sealing member 371 such as an o-ring is disposed between piston support 373 and the access opening 308. Although the retaining member 307 and the piston support 373 are shown as separate components, it is contemplated that they may be integrated as a single component. The piston support 373 includes a recess 374 for receiving the cylinder 375 and a bore 376 to support the piston 380. The proximal end of the piston 380 is disposed in a chamber 377 of the cylinder 375, and the distal end of the piston 380 is attached to the valve body 320. The proximal end of the piston 380 is movable in the chamber 377 as the piston 380 moves between a retracted position and an extended position. FIG. 3 shows the piston 380 in the extended position, which moves the valve body 320 to the closed position. The piston and cylinder assembly 370 may be powered using hydraulic fluid, pneumatic fluid, or electricity. In addition to a piston and cylinder assembly 370, it is contemplated other suitable actuation devices may be used to operate the discharge valve 292. For example, an electric motor or an electric slider may be used to operate the discharge valve 292. In some embodiments, an optional biasing member 318 is used to bias the valve body 320 toward the valve seat 340. FIG. 3 shows the biasing member 318 disposed between the valve body 320 and the piston support 373.

In some embodiments, the suction valve 290 is operated by the biasing member 318, as shown in FIGS. 2A and 2B. In this example, the piston and cylinder assembly 370 is optional. In some embodiments, at least one of the suction valve 290 and the discharge valve 292 is operated by an actuation device such as the piston and cylinder assembly 370.

In some embodiments, operation of at least one of the suction valve 290 and the discharge valve 292 is based on a position of the plunger 208. In one embodiment, one or more position sensors may be used to determine the position of the plunger 208. In one example, a position sensor 411, such as a linear position transducer, is located in the fluid end section 201 of the pump housing 202 to measure the position of the plunger 208. In another example, a position sensor 412, such as a linear position transducer, is located adjacent the rod 226 to measure the position of the crosshead 206, which corresponds to the position of the plunger 208. In yet another example, a position sensor 413, such as an encoder, is located adjacent the crankshaft 212 to measure the position of the crankshaft 212, which corresponds to the position of the plunger 208.

The position of the plunger 208 is sent to a controller 420 configured to operate the piston and cylinder assembly 370 to open or close the discharge valve 292 based on the position of the plunger 208. For example, when the plunger 208 reaches or crosses a discharge position threshold during its extension into the crossbore 244, the controller 420 can open the discharge valve 292. In one example, the discharge position threshold is at the beginning of the plunger's 208 extension. In another example, the discharge position threshold is a distance from 1% to 30% of the total distance of the plunger's 208 extension. The controller 420 can close the discharge valve 292 when the plunger 208 reaches or crosses a suction position threshold during its retraction away from the crossbore 244. In one example, the suction position threshold is when the plunger 208 is at the beginning of its retraction. In another example, the suction position threshold is a distance from 1% to 30% of the total distance of the plunger's 208 retraction.

In operation, the plunger assembly 204 reciprocates between the power end section 203 and the fluid end section 201 of the pump housing 202. The plunger 208 of the plunger assembly 204 may extend through the fluid end section 201 of the pump housing 202 and into the crossbore 244 of the fluid end 104*a*. In one embodiment, the plunger assembly 204 has a stroke length of about 6 inches. In another embodiment, the plunger assembly 204 has a stroke length between about 6 inches to 12 inches. In another embodiment, the plunger assembly 204 has a stroke length less than about 6 inches. In yet another embodiment, the plunger assembly 204 has a stroke length greater than about 12 inches.

The sleeve 210 moves with the plunger 208 as the plunger assembly 204 reciprocates between the power end section 203 and the fluid end section 201. The sleeve 210 maintains a fluid seal between the power end section 203 and the fluid end section 201 of the pump housing 202 to prevent, during the reciprocating movement of the plunger assembly 204, cross contamination (of fluids and/or solids) between the fluid end section 201 and the power end section 203. In one embodiment, the plunger assembly 204 prevents the travel of lubrication fluid from the fluid end section 201 to the power end section 203, which, over time, may deteriorate and contaminate the power end 106*a* of the pump 102*a*.

FIG. 2A shows the plunger 208 in the retracted position and ready for extension. The crossbore 244 is at least partially filled with fluid, and the suction valve 290 is closed due to the pressure in the crossbore 244. In one example, the discharge position threshold for opening the discharge valve 292 is the beginning of the plunger's 208 extension into the crossbore 244. The controller 420 will open the discharge valve 292 by retracting the piston 380 of the piston and cylinder assembly 370. In some examples, the discharge position threshold for opening the discharge valve 292 is a predetermined distance after the start of the plunger's 208 extension. The position of the plunger 208 can be determined using any of the position sensors 411, 412, 413. The controller 420 can delay opening the discharge valve 292 until after the piston 380 has crossed the discharge position threshold to allow the pressure in the crossbore 244 to build, and in some instances, to close the suction valve 290. As the plunger 208 continues to extend, the piston 380 will maintain the discharge valve 292 in the open position so the fluid in the crossbore 244 can flow into the outlet bore 243. In this respect, use of the piston and cylinder assembly 370 advantageously prevents chattering of the discharge valve 292 caused by turbulence from the fluid flowing out of the crossbore 244. In this manner, the impact between the valve body 320 (including the valve seal 338) and the valve seat 340 can be minimized, thereby reducing wear on the discharge valve 292. In turn, the costs associated with maintaining or replacing the discharge valve 292 can be reduced.

After discharging the fluid in the crossbore 244, the plunger 208 is retracted to refill the crossbore 244. In one example, the beginning of the plunger's 208 retraction away from the crossbore 244 is the suction position threshold for closing the discharge valve 292. The controller 420 will close the discharge valve 292 by extending the piston 380 of the piston and cylinder assembly 370 so that the valve seal 338 engages the sealing surface 350 of the valve seat 340. In some examples, the suction position threshold for closing the discharge valve 292 is a predetermined distance after the start of the retraction. The controller 420 can close the discharge valve 292 after the piston 380 has crossed the suction position threshold. As the plunger 208 retracts, the pressure in the crossbore 244 will decrease, thereby creating a pressure differential between the inlet bore 242 and the crossbore 244 that is sufficient to overcome the biasing force of the biasing member 318 of the suction valve 290. As a result, the suction valve 290 will open to allow fluid from the inlet bore 242 to enter and at least partially fill the crossbore 244. During the plunger's retraction, the piston 380 will maintain the discharge valve 292 in the closed position. In this respect, use of the piston and cylinder assembly 370 advantageously prevents chattering of the discharge valve 292 caused by turbulence from the fluid flowing into the crossbore 244. In this manner, wear on the discharge valve 292 is reduced while the crossbore 244 is being filled. The crossbore 244 will continue to fill until the pressure differential is no longer sufficient to keep the suction valve 290 open. At which time, the process of filling and discharging the crossbore 244 repeats. Although the suction valve 290 is operated by the biasing member 318, it must be noted that the suction valve 260 can also be operated using an actuation device such as the piston and cylinder assembly 370.

In some embodiments, operation of at least one of the suction valve 290 and the discharge valve 292 is based on the pressure in one or more of the crossbore 244, the outlet bore 243, and the inlet bore 242. One or more pressure sensors may be positioned to measure the pressure at one or more of these bores 242, 243, 244. The pressures measured at one or more of these bores 242, 243, 244 are sent to the controller 420, which is configured to operate the piston and cylinder assembly 370 to open or close the discharge valve 292 based on the measured pressures at one or more of these locations.

Figure 4:
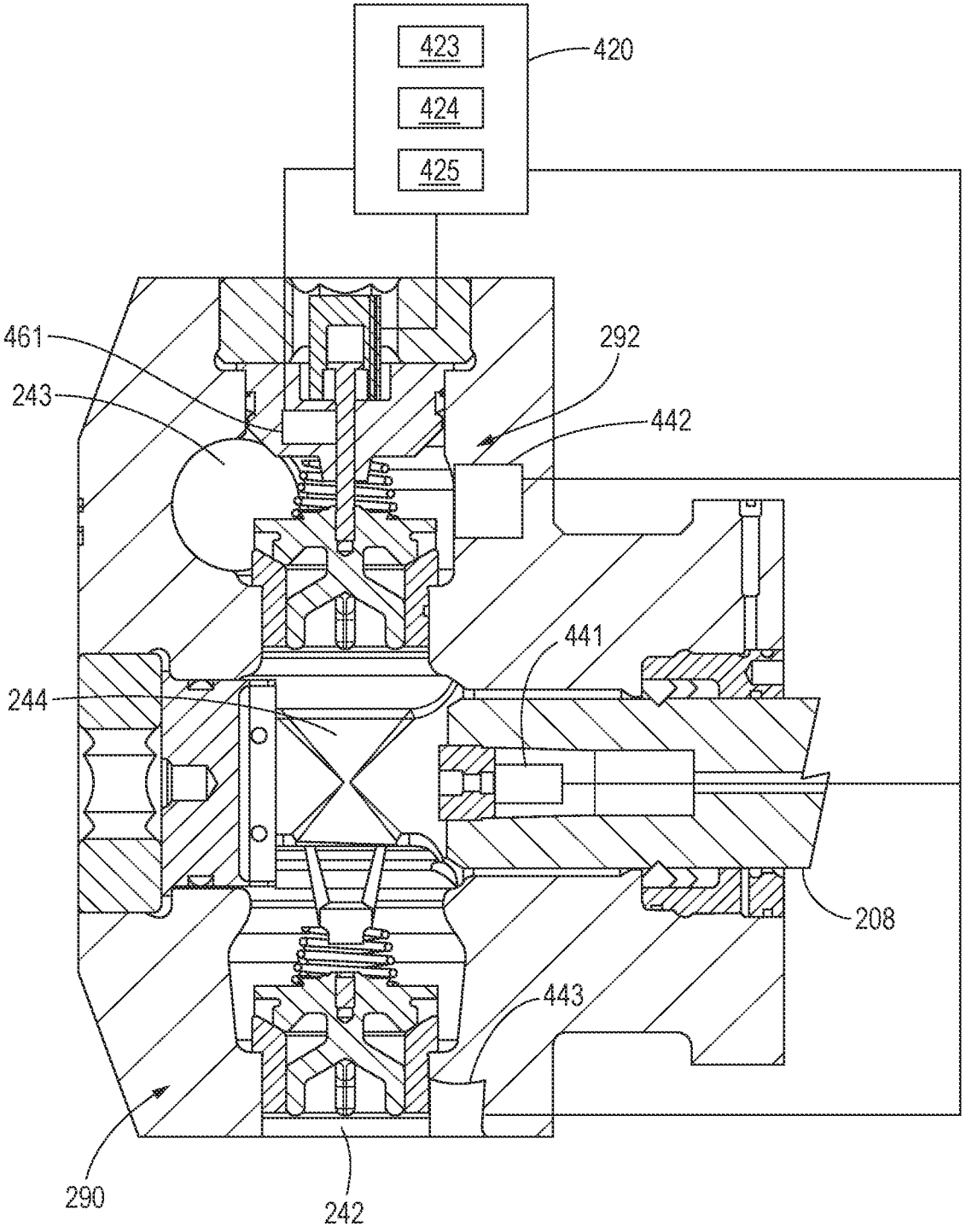
FIG. 4 illustrates an exemplary embodiment of a plunger equipped with a pressure sensor for measuring the pressure in the crossbore, according to one embodiment.

In FIG. 4, the plunger 208 is equipped with a pressure sensor 441 for measuring the pressure in the crossbore 244. In this example, the pressure sensor 441 is disposed inside the plunger 208 and is configured to measure the pressure in the crossbore 244. The pressure sensor 441 can be any suitable pressure sensor for measuring the fluid pressure in the crossbore 244.

Figure 5:
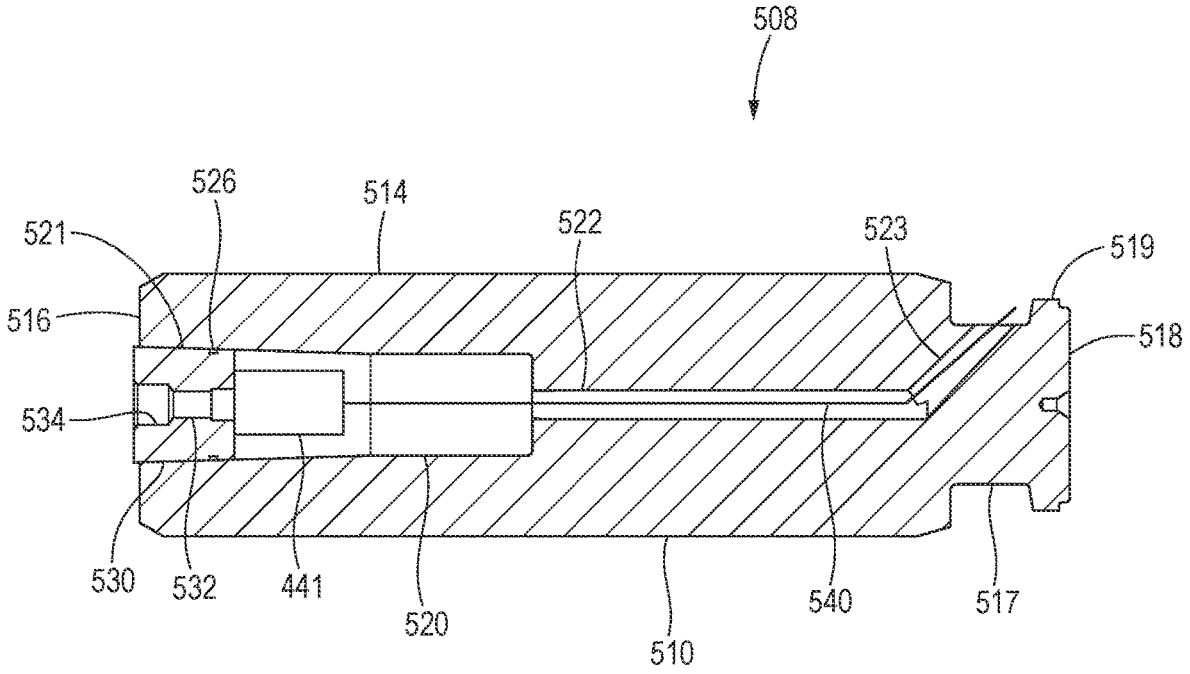
FIG. 5 illustrates another exemplary embodiment of a plunger equipped with a pressure sensor for measuring the pressure in the crossbore, according to one embodiment.

FIG. 5 illustrates an exemplary embodiment of a plunger 508 suitable for use as a plunger in a pump, such as plunger 208 in the pumps 102*a*, 102*b*. In this embodiment, the plunger 508 includes a tubular body 510 having a chamber 520 formed therein. The chamber 520 is open at the front end 516 of the plunger 508 facing the crossbore 244 and is sufficiently sized to house the pressure sensor 441. The back end 518 of the plunger 508 is configured for coupling with a crosshead, such as crosshead 206. In this embodiment, the plunger 508 includes a circumferential recess 517 close to the back end 518 to facilitate coupling with the crosshead 206. The diameter 519 of the back end 518 is larger than the diameter of the recess 517 but smaller than the outer diameter 514 of the plunger 508.

A plug 530 is provided to close the front end of the chamber 520. An optional sealing member 526 is disposed between the plunger 508 and the tubular body 510 defining the chamber 520. In some embodiments, the outer surface 521 of the plug 530 has a taper for engaging a corresponding taper formed on the inner surface of the tubular body 510. The plug 530 may be engaged to the tubular body 510 using threads, interference fit, or other suitable engagement mechanisms. A plug bore 532 extends through the plug 530 and provides fluid communication between the crossbore 244 and the pressure sensor 441 in the chamber 520. The front end of the plug bore 530 is configured to receive a retrieval tool to facilitate removal of the plug 530 from the tubular body 510. In one example, the front end of the plug bore 530 includes threads 534 for mating with the retrieval tool.

The chamber 520 is in fluid communication with a plunger bore 522. The plunger bore 522 is sufficiently sized to accommodate a wire 540 for transferring information, such as measured data, between the pressure sensor 441 and the controller 420. As shown, the plunger bore 522 exits the tubular 510 at the recess 517. The plunger bore 522 include an angled section 523 to direct the plunger bore 522 toward the recess 517. However, it is contemplated the plunger bore 522 may exit the tubular body 510 at the back end 518 or a non-recessed part of the tubular body 510.

Referring back to FIG. 4, the pressure measured by the pressure sensor 441 is sent to the controller 420 for operating the discharge valve 292, the suction valve 290, or both. In one example, when the pressure in the crossbore 244 reaches a predetermined discharge pressure threshold, the controller 420 can open the discharge valve 292. The controller 420 can close the discharge valve 292 when the measured pressure reaches a predetermined suction pressure threshold. Similarly, an outlet pressure sensor 442 can be provided to measure the pressure of the outlet bore 243. The controller 420 can close the discharge valve 292 when the pressure in the outlet bore 243 reaches a predetermined outlet suction pressure threshold and open the discharge valve 292 when the measured pressure reaches a predetermined outlet discharge pressure threshold. An inlet pressure sensor 443 can be provided to measure the pressure of the inlet bore 242. The controller 420 can close the discharge valve 292 when the pressure of the inlet bore 242 reaches a predetermined inlet suction pressure threshold and open the discharge valve 292 when the measured pressure reaches a predetermined outlet discharge pressure threshold.

FIG. 4 shows the plunger 208 in the retracted position and ready for extension. The crossbore 244 is at least partially filled with fluid, and the suction valve 290 is closed due to the pressure in the crossbore 244. The discharged valve 292 is in the closed position. In one example, the pressure in the crossbore 244 measured by the pressure sensor 441 in the plunger 208 has reached the predetermined discharge pressure threshold. In response, the controller 420 will open the discharge valve 292 by retracting the piston 380 of the piston and cylinder assembly 370. As the plunger 208 continues to extend, the piston 380 will maintain the discharge valve 292 in the open position so the fluid in the crossbore 244 can flow into the outlet bore 243. Although the discharge pressure threshold is reached while the plunger 208 is fully retracted, it is contemplated that the discharge pressure threshold may be reached while the plunger 208 is retracting or extending. In the event the discharge pressure threshold is reached during retraction, the controller 420 may optionally open the discharge valve 292 and begin discharging the fluid in the crossbore 244 while the plunger 208 continues to retract. Use of the piston and cylinder assembly 370 to keep the discharge valve 292 in the open position advantageously prevents chattering of the discharge valve 292 caused by turbulence from the fluid flowing out of the crossbore 244. The controller 420 will continue to monitor the pressure in the crossbore 244 until the suction pressure threshold is reached.

After discharging the fluid in the crossbore 244, the plunger 208 is retracted to refill the crossbore 244. The controller 420 will close the discharge valve 292 when pressure in the crossbore 244 reaches the predetermined suction pressure threshold. The suction pressure threshold may be reached when the plunger 208 is extending, retracting, or fully extended. The controller 420 can close the discharge valve 292 by extending the piston 380 of the piston and cylinder assembly 370 so that the valve seal 338 engages the sealing surface 350 of the valve seat 340. During retraction, the pressure in the crossbore 244 will decrease, thereby creating a pressure differential between the inlet bore 242 and the crossbore 244 that is sufficient to overcome the biasing force of the biasing member 318 of the suction valve 290. As a result, the suction valve 290 will open to allow fluid from the inlet bore 242 to enter and at least partially fill the crossbore 244. The piston 380 will maintain the discharge valve 292 in the closed position until the discharge pressure threshold is reached. In this respect, use of the piston and cylinder assembly 370 advantageously prevents chattering of the discharge valve 292 caused by turbulence from the fluid flowing into the crossbore 244. In this manner, wear on the discharge valve 292 is reduced while the crossbore 244 is being filled. The crossbore 244 will continue to fill until the pressure differential is no longer sufficient to keep the suction valve 290 open. At which time, the process of filling and discharging the crossbore 244 repeats.

In some embodiments, the controller 420 can operate the discharge valve 292 based on measured data of at least two of the plunger position, the crossbore pressure, the outlet pressure, and the inlet pressure. In one embodiment, the controller 420 opens or closes the discharge valve 292 based on the plunger's position and one of the measured pressures. In one example, the controller 420 opens the discharge valve 292 after the plunger 208 has reached the discharge position threshold as measured by one of the position sensors 411, 412, 413, and the pressure at the outlet bore 243 (or the crossbore 244 or inlet bore 242) has reached the discharge pressure threshold as measured by the one of the outlet pressure sensor 442 (or the pressure sensor 441 or inlet pressure sensor 443). In other words, if only one of the discharge position threshold or the discharge pressure threshold has been reached, the controller 420 will not open the discharge valve 292 until the other threshold has been reached. Similarly, the controller 420 closes the discharge valve 292 after the plunger 208 has reached the suction position threshold as measured by one of the position sensors 411, 412, 413, and the pressure at the outlet bore 243 (or the crossbore 244 or inlet bore 242) has reached the suction pressure threshold as measured by the one of the outlet pressure sensor 442 (or the pressure sensor 441 or inlet pressure sensor 443). In other words, if only one of the suction position threshold or the suction pressure threshold has been reached, the controller 420 will not close the discharge valve 292 until the other threshold has been reached.

In some embodiments, the measured data from the position sensors and the pressure sensors are used to predict when the discharge valve 292 or the suction valve 290 may require maintenance. For example, during operation, the plunger 208 discharge position threshold is initially correlated to a discharge pressure threshold such that when the discharge position threshold is reached, the discharge pressure threshold is also reached or is close to being reached. However, over time, the correlation may begin to weaken such that when the plunger 208 reaches the discharge position threshold, the discharge pressure threshold is not as close to being reached. In this instance, the controller 420 can send a maintenance required signal to the operator.

In another embodiment, the pumps 102*a*, 106*b* may include a vibration sensor 461 for measuring a vibration of the discharge valve 292 or the suction valve 290. The controller 420 is configured to receive the vibration data from the vibration sensor 461 and to send out a maintenance signal to the operator. In one example, the controller 420 will send out a maintenance signal if a vibration threshold is measured. In another example, the controller 420 monitors the vibration data to identify a potential trend of wear on the discharge valve 292 or suction valve 290.

In some embodiments, the controller 420 is configured to operate the first pump 102*a*, the second pump 102*b*, or both. In some embodiments, the controller 420 is located onsite, such as on the pump 102*a*, or at a remote location. Exemplary pumps 102*a*, 102*b* operable by the controller 420 include a fracturing pump, a cement pump, and a mud pump. Data from the position sensors 411, 412, 413, the pressure sensors 441, 442, 443, and the vibration sensor 461 may be sent to a data storage located onsite or to a remote location.

In one example, the measured data is sent to a data van. In another example, the measured data is sent, via satellite, to a cloud system.

The controller 420 disclosed herein includes a central processing unit (CPU) 423, a memory 424, and support circuits 425. The controller 420 is configured to take action in response to measured data received from the position sensors 411, 412, 413, the pressure sensors 441, 442, 443, and the vibration sensor 461, including operating the discharge valve 292 and suction valve 290 and sending a maintenance signal. The CPU 423 is a general purpose computer processor configured for use in an industrial setting for monitoring and controlling a pump and operations related thereto. The memory 424 described herein may include random access memory, read only memory, floppy or hard disk drive, or other suitable forms of digital storage, local or remote. The support circuits 425 are conventionally coupled to the CPU 423 and comprise cache, clock circuits, input/output subsystems, power supplies, and the like, and combinations thereof. Software instructions (program) and data can be coded and stored within the memory 424 for instructing a processor within the CPU 423. A software program (or computer instructions) readable by CPU 423 in the controller 420 determines which action is to be taken in response to information received from the position sensors 411, 412, 413, the pressure sensors 441, 442, 443, and the vibration sensor 461. Preferably, the program, which is readable by CPU 423 in the controller 420, includes code, which when executed by the processor (CPU 423), takes action relating to monitoring and operating the pump described herein. The program will include instructions that are used to control the various hardware and electrical components within the pump to perform the various tasks used to implement the operational schemes described herein.

In one embodiment, a method of operating a pump includes extending a plunger into a crossbore of the pump. The crossbore is in selective fluid communication with an outlet bore and an inlet bore. The method also includes determining a pressure in at least one of the crossbore, the outlet bore, and the inlet bore. In response to the pressure reaching a discharge pressure threshold, a discharge valve in the pump is opened to discharge fluid from the crossbore into the outlet bore. The method also includes retracting the plunger. In response to the pressure reaching a suction pressure threshold, the discharge valve is closed. The inlet bore is opened to allow fluid to flow into the crossbore.

In one or more of the embodiments described herein, the method also includes determining a position of the plunger and opening the discharge valve only if the position of the plunger reaches a discharge position threshold.

In one or more of the embodiments described herein, the method also includes measuring a vibration of one or more of the discharge valve and the suction valve and sending a maintenance required signal to an operator.

While the foregoing is directed to specific examples, other examples may be devised without departing from the basic scope thereof, and the scope thereof is determined by the claims that follow.

The invention claimed is:

1. A pump, comprising,
- a power end having a plunger movable between a retracted position and an extended position; and
- a fluid end coupled to the power end, the fluid end having:
  - an inlet bore;
  - an outlet bore;
  - a crossbore in selective fluid communication with the inlet bore and the outlet bore;
  - a suction valve for controlling fluid communication between the inlet bore and the crossbore;
  - a discharge valve for controlling fluid communication between the outlet bore and the crossbore;
  - a piston and cylinder assembly for moving the discharge valve between an open position and a closed position, wherein a piston of the piston and cylinder assembly is coupled at one end to a valve body of the discharge valve, and wherein a cylinder of the piston and cylinder assembly is at least partially disposed in a retaining member, which is at least partially disposed in an access opening of the fluid end;
  - at least one of:
    - a position sensor for measuring a position of the plunger; or
    - a pressure sensor for measuring a pressure of the crossbore, the inlet bore, or the outlet bore; and
- a processing unit controller for operating the discharge valve via the piston and cylinder assembly based on data from at least one of the position sensor or the pressure sensor.

2. The pump of claim 1, wherein the piston and cylinder assembly is powered by hydraulic fluid, pneumatic fluid, or electricity.

3. The pump of claim 1, wherein the position sensor is configured to measure a position of at least one of a crosshead or a crankshaft.

4. The pump of claim 1, further comprising an actuator for moving the suction valve between an open position and a closed position.

5. The pump of claim 1, wherein the pressure sensor is disposed in the plunger and measures the pressure of the crossbore.

6. The pump of claim 5, wherein the plunger includes:
- a chamber for housing the pressure sensor; and
- a plug for closing one end of the chamber.

7. The pump of claim 1, wherein the piston and cylinder assembly further comprises a support member, wherein the support member includes a bore for supporting the piston, and wherein the support member is disposed inward of the retaining member in the access opening.

8. The pump of claim 1, wherein the processing unit controller operates the discharge valve based on data from the position sensor and the pressure sensor.

9. A pump system, comprising:
- a first pump having a first fluid end and a first power end;
- a second pump having a second fluid end and a second power end, wherein the first pump is positioned adjacent the second pump such that the first power end abuts the second power end, wherein the first pump and second pump having a total length less than or equal to 102, and wherein the first pump and the second pump each comprise:
  - a power end having a plunger movable between a retracted position and an extended position; and
  - a fluid end coupled to the power end, the fluid end having:
    - an inlet bore;
    - an outlet bore;
    - a crossbore in selective fluid communication with the inlet bore and the outlet bore;
    - a suction valve for controlling fluid communication between the inlet bore and the crossbore;
    - a discharge valve for controlling fluid communication between the outlet bore and the crossbore;
    - a piston and cylinder assembly for moving the discharge valve between an open position and a closed position, wherein a piston of the piston and cylinder assembly is coupled at one end to a valve body of the discharge valve, and wherein a cylinder of the piston and cylinder assembly is at least partially disposed in a retaining member, which is at least partially disposed in an access opening of the fluid end;

at least one of:

a position sensor for measuring a position of the plunger; or a pressure sensor for measuring a pressure of the crossbore, the inlet bore, or the outlet bore; and a processing unit controller for operating the discharge valve via the piston and cylinder assembly based on data from at least one of the position sensor or the pressure sensor.

10. The pump system of claim 9, wherein the position sensor is configured to measure the position of the plunger by measuring a position of a crosshead or a position of a crankshaft.

11. The pump system of claim 9, further comprising a an actuator for moving the suction valve between an open position and a closed position.

12. The pump system of claim 9, wherein the pressure sensor is disposed in the plunger and measures the pressure of the crossbore.

13. A method of operating a pump, comprising:

extending a plunger into a crossbore of the pump;

determining a position of the plunger;

in response to the plunger crossing a discharge position threshold, actuating a piston and cylinder assembly to open a discharge valve in the pump to discharge fluid from the crossbore into an outlet bore of the pump, wherein a piston of the piston and cylinder assembly is coupled at one end to a valve body of the discharge valve, and wherein a cylinder of the piston and cylinder assembly is at least partially disposed in a retaining member, which is at least partially disposed in an access opening of the pump;

retracting the plunger;

in response to the plunger crossing a suction position threshold, closing the discharge valve; and opening an inlet bore to allow fluid to flow into the crossbore.

14. The method of claim 13, further comprising:

determining a pressure in the crossbore; and opening the discharge valve only if the pressure in the crossbore reaches a discharge pressure threshold.

15. The method claim 13, wherein the piston and cylinder assembly further comprises a support member, wherein the support member includes a bore for supporting the piston, and wherein the support member is disposed inward of the retaining member in the access opening.

16. The method of claim 13, wherein opening the inlet bore comprises opening a suction valve based on the inlet bore having a pressure greater than the pressure in the crossbore.

* * * * *